US005540446A

United States Patent [19]

Felsen

[11] Patent Number: 5,540,446

[45] Date of Patent: Jul. 30, 1996

[54] COVERS AND TARGET PATTERN APPLIQUÉS

[76] Inventor: Karl H. Felsen, 47 Matinee Bay, Winnipeg, Manitoba, Canada, R2G 1X9

[21] Appl. No.: 524,505

[22] Filed: Sep. 7, 1995

[51] Int. Cl.[6] ..... F41J 3/00

[52] U.S. Cl. ..... 273/403; 273/408

[58] Field of Search ..... 273/403, 404, 273/408, 409

[56] References Cited

U.S. PATENT DOCUMENTS

| | | | |
|---|---|---|---|
| 1,928,768 | 10/1933 | Sell et al. . | |
| 2,179,471 | 11/1939 | Lee . | |
| 2,214,486 | 9/1940 | Snyder . | |
| 3,048,401 | 8/1962 | Dishon . | |
| 3,244,419 | 4/1966 | Lerman . | |
| 3,300,216 | 1/1967 | Haecker | 273/403 |
| 3,504,913 | 4/1970 | Bilotti . | |
| 4,203,600 | 5/1980 | Brown . | |
| 4,239,236 | 12/1980 | Porham et al. | 273/407 |
| 4,477,082 | 10/1984 | McKenzie et al. . | |
| 4,811,956 | 4/1989 | Foreman . | |
| 5,169,158 | 12/1992 | Neville . | |
| 5,197,743 | 4/1993 | Hanson, Jr. . | |

FOREIGN PATENT DOCUMENTS

| | | | |
|---|---|---|---|
| 2417743 | 10/1979 | France | 273/403 |
| 3138015 | 4/1983 | Germany | 373/403 |

OTHER PUBLICATIONS

Targ–D advertisement, Sep. 1984.

*Primary Examiner*—Mark S. Graham

*Attorney, Agent, or Firm*—Adrian D. Battison; Murray E. Thrift

[57] ABSTRACT

The present invention provides a cover and removable and replaceable target pattern appliqués for use with dart boards, archery targets, and the like. The cover and target pattern appliqués are simple to install on a dart board or archery target and allow the user to remove and replace the current target pattern with a variety of target patterns. The dart board cover comprises a cover body, means for holding the cover body on the dart board, and a front panel member for receiving a target pattern appliqué. A target pattern appliqués can be fixed to the front panel, be removed, and be replaced with another target pattern appliqué quickly and easily.

20 Claims, 4 Drawing Sheets

COVERS AND TARGET PATTERN APPLIQUÉS

FIELD OF THE INVENTION

The present invention provides a cover and target pattern appliqués for use with dart boards, archery targets, and the like.

BACKGROUND

Conventional dart boards and archery targets are usually limited to having a permanent target pattern on one or both of their faces. The target pattern is generally permanently fixed or printed to the face of the dart board or archery target on which it resides.

It is often desirable, however, to have a variety of targets with differing patterns to either help improve the player or archers skill level, or to keep the activity entertaining. Dart boards and archery targets have been suggested in the past which have targets with game or target patterns other than the traditional dart board pattern or archery target pattern. Most of these, however, are permanently fixed or printed onto the dart board or archery target. Few arrangements have been suggested where the pattern has been changeable. Some targets with changeable target patterns have been suggested, although these usually have not been designed for use with dart boards or archery targets and have often been unnecessarily elaborate or complex.

A target pattern for use with dart boards, archery targets, and the like is needed which is simple to install and which allows the user to remove and replace one target pattern with a variety of other target patterns.

SUMMARY

According to the present invention there is provided a cover for use with a target member such as a dart board or archery target having a front face and a rear face, said cover comprising:

- a cover body for enclosing the target member, having a front face for overlaying the front face of the target member;
- means for holding the cover body in place on said target member;
- a front panel member arranged on the front face of the cover body;
- a target appliqué having a printed representation on a front side, and face to face fastening means on a rear side for removably fastening to the front panel member;
- the front panel member having a surface characteristic such that the face to face fastening means of the target appliqué are readily removable and reengagable thereon.

Preferably the cover body is composed of a stretchable material and the front panel is composed of a non-stretchable material. The front panel member is arranged at a centre of the front face of the cover body, for accepting the target appliqué and has a smooth surface which cooperates with adhesive on the back of the target appliqué such that the target appliqué is readily removable and reengagable on the front panel member. The target appliqué has the adhesive arranged on a back side and has a removable peel-back covering to cover the adhesive until the appliqué is used.

According to a second aspect of the invention there is provided a target comprising:

- a circular disc having a front face and a rear face;
- a cover body for enclosing the target member, having a front face for overlaying the front face of the target member;
- means for holding the cover body in place on said target member;
- a front panel member arranged on the front face of the cover body;
- a target appliqué having a printed representation on a front side, and face to face fastening means on a rear side for removably fastening to the front panel member;
- the front panel member having a surface characteristic such that the face to face fastening means of the target appliqué are readily removable and reengagable thereon.

Preferably the means for holding the cover body in place on the circular disc comprise a plurality of overlapping eyelets arranged around an outer portion of the cover body, a ring member arranged substantially at the centre of said back face, and a plurality of resilient means each being connected at a first end to a respective one of the plurality of eyelets and being connected at a second end to the ring.

The cover and target pattern appliqués may be used with any type of target having front and back faces over which a cover may be fit as well as with dart boards and archery targets as mentioned above.

An embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
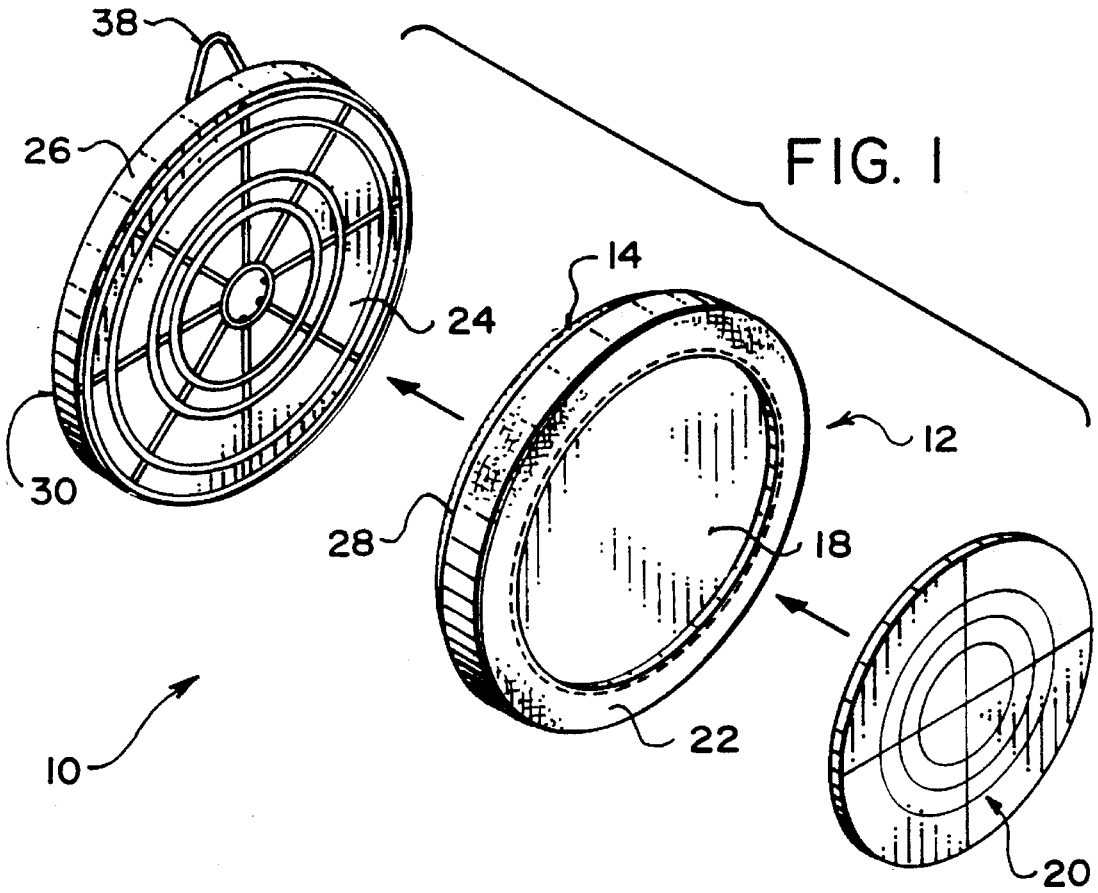
FIG. 1 is an isometric view of a dart board, and the cover and target appliqué.
Figure 2:
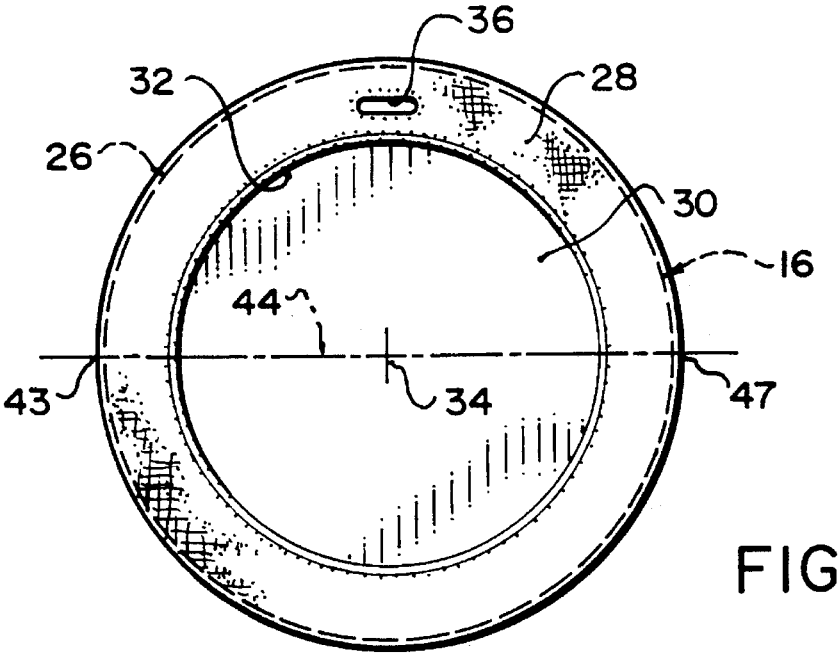
FIG. 2 is a rear view of the cover in place on a dart board showing the gathering means.

Referring to FIGS. 1 and 2 the cover and one target pattern appliqué is shown generally at 10. The cover comprises a cover body 12, means 14 for holding the cover body 12 onto a dart board 16, a front panel member 18, and target pattern appliqués 20 each of which can be fastened onto the front panel 18, be removed therefrom, and be replaced with another appliqué 20.

The cover body 12 has a front face 22 for overlaying the front face 24 of the dart board 16 and extends rearwards from its front face 22 over the sides 26 of the dart board 16 to a back side 28 which engages the back 30 of the dart board 16. The back side 28 of the cover body 12 does not fully enclose the back 30 of the dart board 16 but ends at a peripheral edge 32 spaced a distance from the sides 26 in towards the centre 34 of the back 30 of the dart board 16. The back side 28 of the cover body 12 includes an elongate reinforced hole 36 at a top thereof for receiving a hanger bracket 38 of the dart board 16 therethrough. The cover body 12 is sized for traditional regulation size dart boards which are 18" in diameter and about 1" to 2" in thickness, but may be sized for any size of dart board.

The cover body 12 is composed of a stretchable material, one example of which is industrial linen which is stretchable and can be penetrated by a projectile such as a dart, yet is sufficiently tough to be long lasting. Any other appropriate fabric may be used as an alternative to industrial linen.

The front panel member 18 is arranged generally centrally on the front face 22 of the cover body 12. The front panel member 18 is composed of a non-stretchable material such as plastic and is arranged to receive the target pattern appliqués 20 thereon. The material used to form the front panel member 18 has a smooth surface having characteristics that allow the target appliqué 20 to be readily removed from and fastened thereon. The size of the front panel member 18 may vary but is typically about 13" in diameter, with a 12" diameter circle and cross hairs imprinted on it.

The means for holding the cover body 12 on the dart board comprise gathering means 14 arranged around the peripheral edge 32 of the back side 28 of the cover body 12. The gathering means 14 is usually a draw string or a heavy duty elongate elastic member sewn into the peripheral edge 32 of the back side 28 of the cover body 12.

Figure 4:
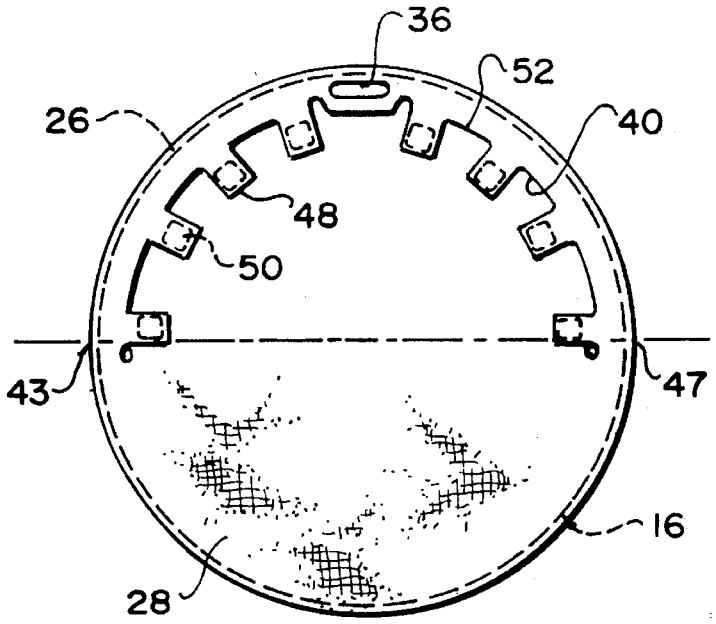
FIG. 4 is a rear view of a second alternative arrangement of the cover in place on a dart board showing the tab closing means.
Figure 3:
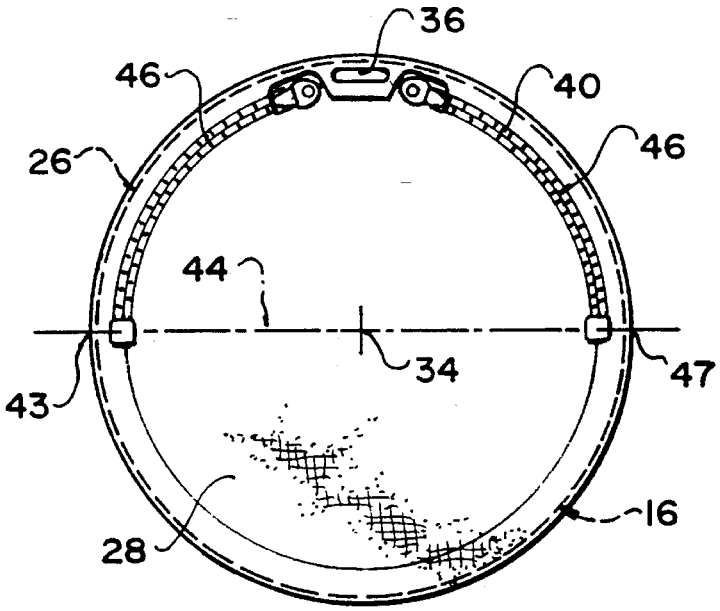
FIG. 3 is a rear view of an alternative arrangement of the cover in place on a dart board showing the zipper closing means.

FIGS. 3 and 4 show an alternative arrangements of the back side 28 of the cover body 12 which enclose the entire back 30 of the dart board 16 and include an opening 40 for receiving the dart board therethrough and closing means for closing the opening 40. The opening 40 follows the curve of the dart board 16 from a left most point 43 on the horizontal midline 44 of the back 30 of the dart board 16 to a rightmost point 47 on the horizontal midline 44 of the back 30 of the dart board 16.

The closing means may comprise at least one zipper 46 or a plurality of tabs 48 with face to face fasteners 50. If zippers 46 are used two zippers, a left and a right hand zipper are preferred.

If tabs 48 are used the tabs 48 are arranged around a top peripheral edge 52 of the opening 40 extending over the opening 40 to the back side 28 of the cover body 12. Removable and reengagable face to face fastening means 50 such as Velcro fasten the tabs 48 to the back side 28 of the cover body 12 closing the opening 40.

Figure 5:
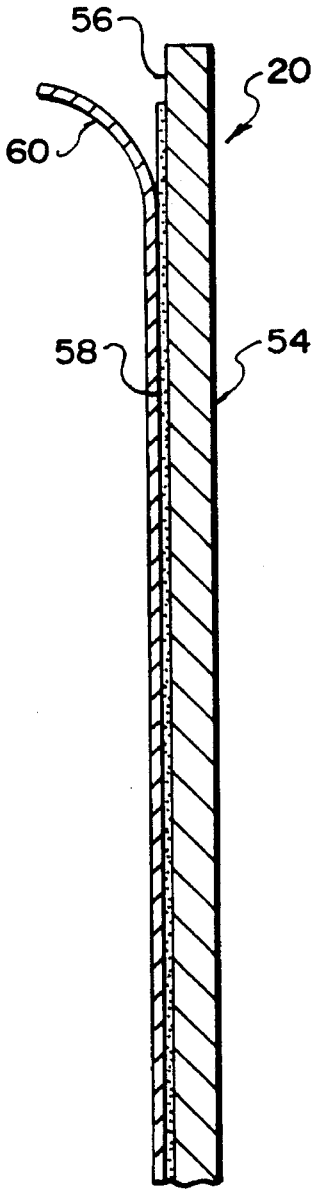
FIG. 5 is a cross sectional view of the target appliqué.

Referring to FIGS. 1 and 5 the target appliqués 20 comprise a decal preferably round in shape that has a target on a front face 54, and face to face fastening means on the rear face 56 for removably fastening to the front panel member 18. The target pattern appliqués 20 have a variety of different target types printed on their front faces 54. Some examples of which are political, corporate, and criminal personalities, fictional characters, geometric shapes, animals, and games.

The face to face fastening means comprise an adhesive 58 and a removable peel-back covering 60. The adhesive 58 is selected such that it cooperates with the front face 22 of the front panel member 18 allowing easy stripping of worn or unwanted target appliqués 20, and replacement of new target pattern appliqués 20 thereon.

The peel-back covering 60 includes printed matter such as game instructions and rules, chronologies, historical facts, and back ground stories which are relevant to the images on the front of the target appliqué 20.

Figure 6:
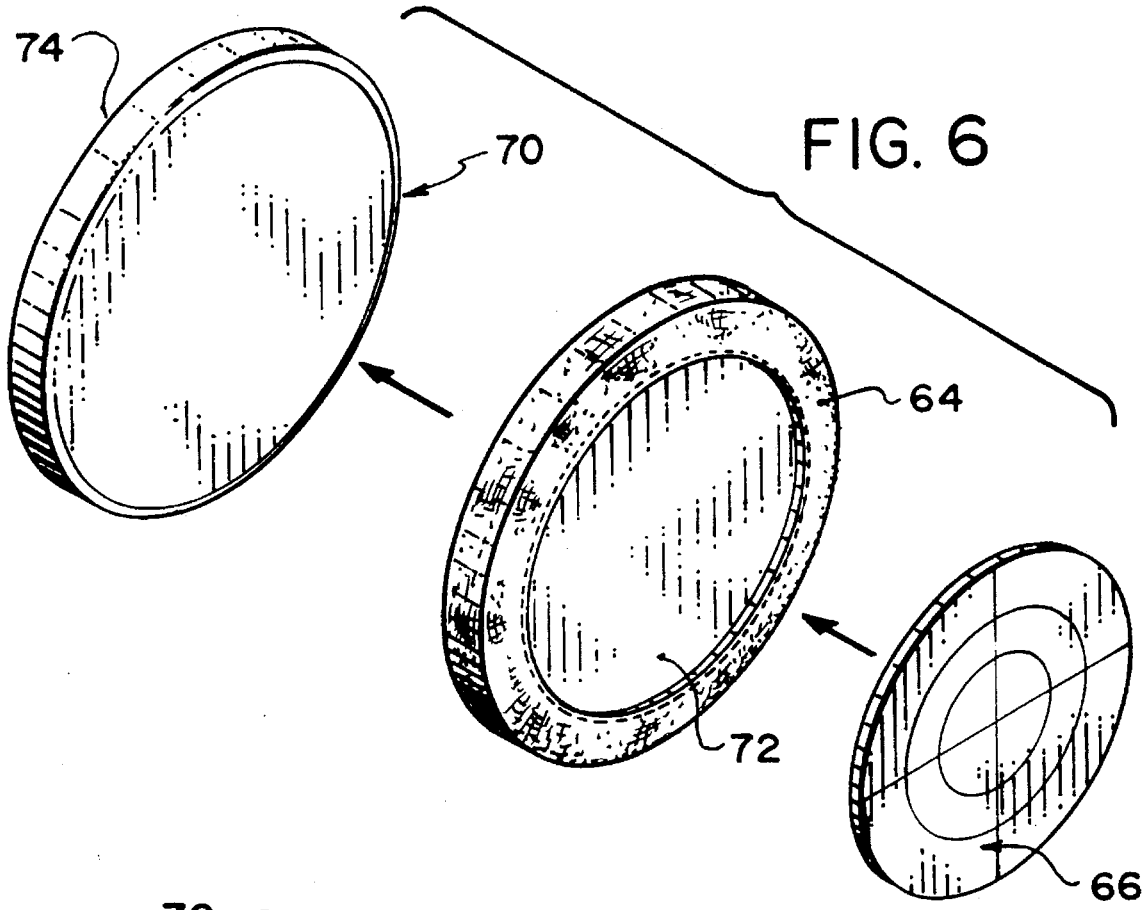
FIG. 6 is an isometric view of an archery target, and the cover and target appliqué.
Figure 7:
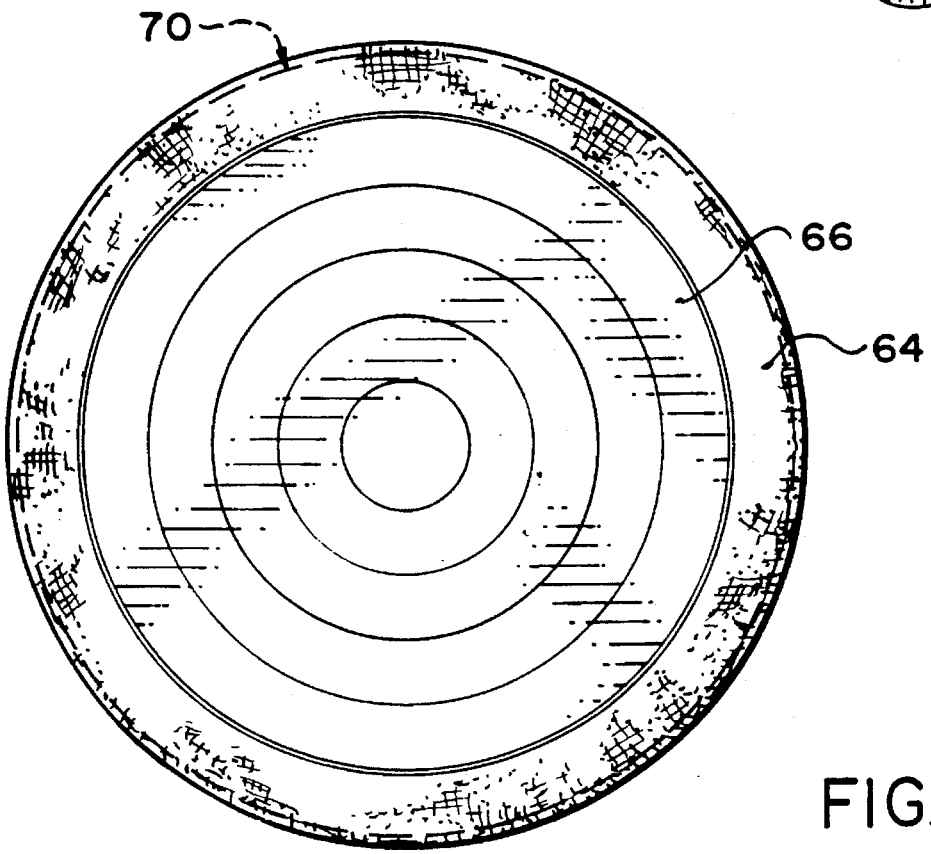
FIG. 7 is a front view of the cover and target appliqué for an archery target.
Figure 8:
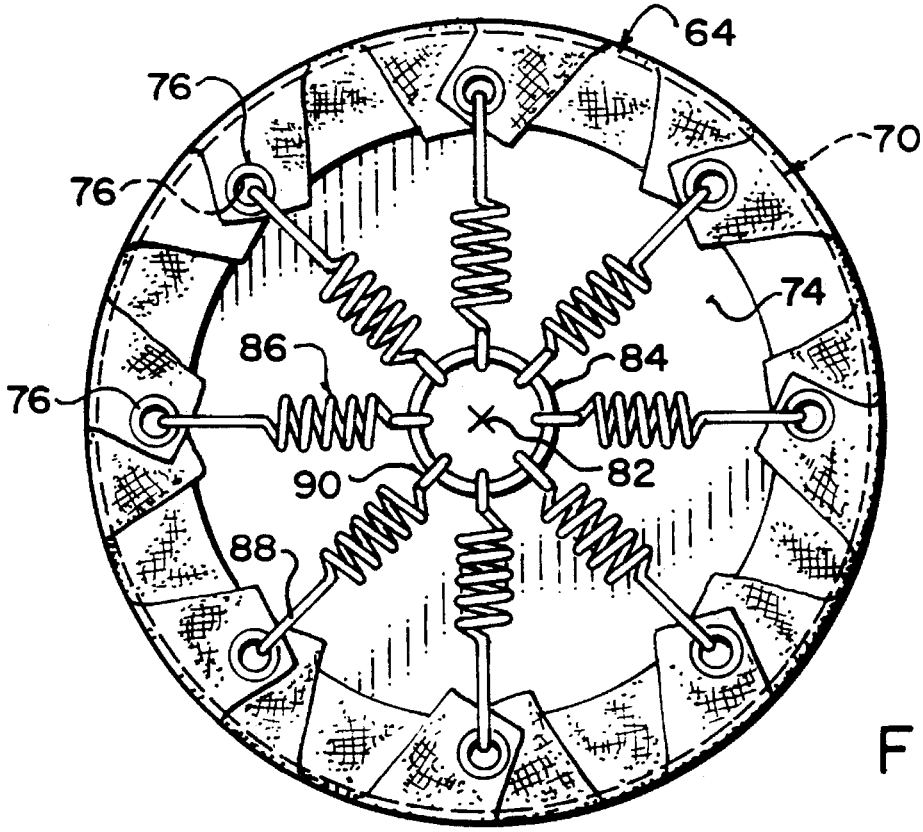
FIG. 8 is a rear view of the cover and target appliqué for an archery target.

Referring to FIGS. 6, 7 and 8 an alternative arrangement of the cover 64 and target pattern appliqués 66 for archery targets are shown. The cover 64 for archery targets typically has a maximum diameter of 48" and is arranged for use over archery boards 70. The cover body 64 is made of a stretchable material such as elasticized canvas material, any other appropriate materials may be used. The cover body 64 includes a front panel member 72 for accepting a target appliqué 66, as in the dart board version, only of dimensions appropriate for archery. The cover 64 is designed for replacement after being excessively damaged by arrows.

The target pattern appliqués 66 for archery targets come in various designs such as images of animals, games, and traditional archery targets of white black blue and red bands with a gold bullseye, as well as other possible designs.

The cover body 64 extends over to the back 74 of the archery board 70 like in the dart board sized embodiment. The means for holding the cover body in place on the archery board 70 comprise a plurality of overlapping eyelets 76 arranged around the perimeter of the back 74 of the cover body 64 and extend inwards toward the centre 82 of the back 74 of the archery board 70. A ring member 84 (3" in diameter) is arranged substantially at the centre 82 of the back 74 of the archery board 70, and is connected via a plurality of resilient means 86 to the plurality of eyelets 76. The each one of the resilient means 86 comprises a coil spring however any appropriate resilient means may be used as an alternative. Each one of the plurality of springs 86 is connected at a first end 88 by an extended hook to respective over-lapping eyelets, and is connected at a second end 90 by a full twist loop to the ring member 84, thus holding the cover 64 in place.

Alternatively draw strings with quick lock and release knobs could be used through eyelets on covers with smaller diameters.

Although dart boards and archery targets have been discussed in the above the cover and target pattern appliqués may be used with any type of target having front and back faces over which a cover may be fit.

Figure 9:
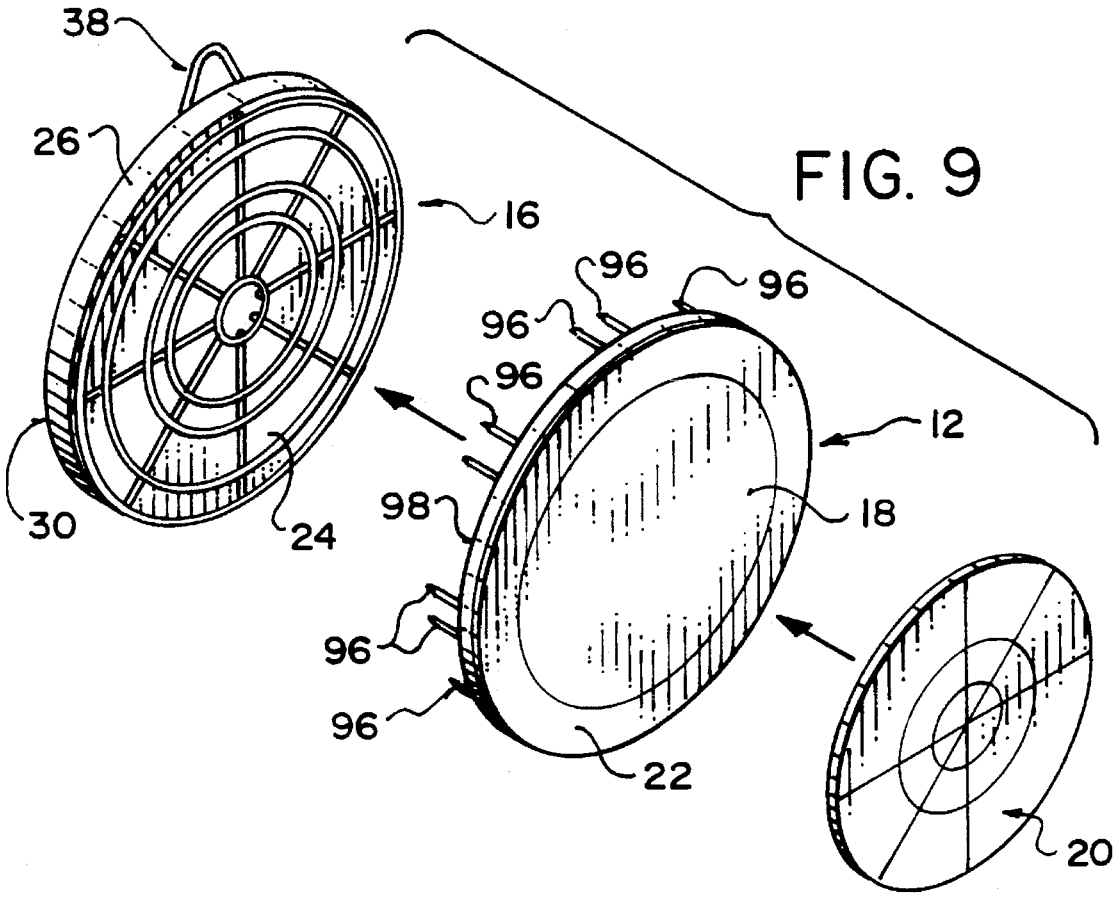
FIG. 9 is an isometric view of a dart board, and the cover and target appliqué showing the alternative pin members for holding the cover on the dart board.

Referring to FIG. 9 a further alternative arrangement is shown with the means for holding the cover body 12 on the target member 16 comprising a plurality of pin members 96 arranged around a peripheral edge 98 of the cover body 12 for penetrating a portion of the target member 16 thereby fixing the cover body 12 in place on the target member 16.

While one embodiment of the present invention has been described in the foregoing, it is to be understood that other embodiments are possible within the scope of the invention. The invention is to be considered limited solely by the scope of the appended claims.

I claim:

1. A cover for use with a target member such as a dart board or archery target having a front face and a rear face, said cover comprising:

a cover body for enclosing at least part of the target member, having a front face for overlaying the front face of the target member;

means for holding the cover body in place on said target member;

a front panel member arranged on the front face of the cover body;

a target appliqué having a printed representation on a front side, and face to face fastening means on a rear side for removably fastening to the front panel member;

the front panel member having a surface characteristic such that the face to face fastening means of the target appliqué are readily removable and reengagable thereon.

2. A cover in accordance with claim 1 wherein the front panel member is arranged at a centre of the front face of the cover body.

3. A cover in accordance with claim 1 wherein the face to face fastening means comprise an adhesive and a removable peel-back covering.

4. A cover in accordance with claim 3 wherein the front panel member has a smooth surface which cooperates with said adhesive such that the target appliqué is readily removable and reengagable thereon.

5. A cover in accordance with claim 4 wherein the peel-back covering includes printed matter on a face thereof.

6. A cover in accordance with claim 1 wherein the cover body includes a back side having an elongate reinforced hole at a top thereof for receiving a hanger bracket therethrough.

7. A cover in accordance with claim 1 wherein the cover body includes a back side covering a portion of the rear face of the target member, and wherein the means for holding the cover body on the target member comprises gathering means arranged around a peripheral edge of the back side of the cover body.

8. A cover in accordance with claim 7 wherein the gathering means is a draw string.

9. A cover in accordance with claim 7 wherein the gathering means is an elongate elastic member.

10. A cover in accordance with claim 1 wherein the means for holding the cover body on the target member comprises a plurality of pin members arranged around a peripheral edge of the cover body for penetrating a portion of the target member thereby fixing said cover body in place on the target member.

11. A cover in accordance with claim 1 wherein a back side of the cover body encloses the entire rear face of the target member and includes an opening for receiving the target member therethrough, and closing means for closing said opening.

12. A cover in accordance with claim 11 wherein the closing means comprise a plurality of tabs arranged around a top peripheral edge of the opening extending over the opening to the back side of the cover body, and removable and reengagable face to face fastening means arranged for fastening said tabs to said back side thereby closing the opening.

13. A cover in accordance with claim 1 wherein the cover body is composed of a stretchable material and wherein the front panel is composed of a non-stretchable material.

14. A cover in accordance with claim 1 wherein the cover body can be penetrated by a projectile.

15. A target comprising:

a circular disc having a front face and a rear face;

a cover body for enclosing at least part of the target member, having a front face for overlaying the front face of the target member;

means for holding the cover body in place on said target member;

a front panel member arranged on the front face of the cover body;

a target appliqué having a printed representation on a front side, and face to face fastening means on a rear side for removably fastening to the front panel member;

the front panel member having a surface characteristic such that the face to face fastening means of the target appliqué are readily removable and reengagable thereon.

16. A cover in accordance with claim 15 wherein the front panel member is arranged at a centre of the front face of the cover body.

17. A cover in accordance with claim 1 wherein the face to face fastening means comprise an adhesive and a removable peel-back covering, and wherein the front panel member has a smooth surface which cooperates with said adhesive such that the target appliqué is readily removable and reengagable thereon.

18. A cover in accordance with claim 17 wherein the means for holding the cover body in place on the circular disc comprise a plurality of overlapping eyelets arranged around an outer portion of the cover body, a ring member arranged substantially at the centre of said back face, and a plurality of resilient means each being connected at a first end to a respective one of the plurality of eyelets and being connected at a second end to the ring.

19. A cover in accordance with claim 17 wherein the circular disk is a dart board.

20. A cover in accordance with claim 17 wherein the circular disk is an archery target.

* * * * *